US005566846A

United States Patent [19]

James

[11] Patent Number: 5,566,846

[45] Date of Patent: *Oct. 22, 1996

[54] BUTTON ENHANCEMENT COATING SYSTEM

[75] Inventor: Albert J. James, Chicago, Ill.

[73] Assignee: Continental White Cap, Inc., Northbrook, Ill.

[ * ] Notice: The term of this patent shall not extend beyond the expiration date of Pat. No. 5,474,194.

[21] Appl. No.: 193,808

[22] Filed: Feb. 8, 1994

Related U.S. Application Data

[63] Continuation of Ser. No. 61,272, May 13, 1993, abandoned, which is a continuation of Ser. No. 884,866, May 13, 1992, abandoned, which is a continuation of Ser. No. 585,179, Sep. 20, 1990, abandoned.

[51] Int. Cl.[6] ..... B65D 39/00

[52] U.S. Cl. ..... 215/230; 215/250; 215/270; 215/271; 426/87; 426/383; 428/209; 428/916; 116/270; 116/335; 116/212

[58] Field of Search ..... 215/230, 250, 215/270, 271; 220/214, 624, DIG. 16; 426/87, 383; 116/212, 270, 335; 206/459; 428/209, 916

[56] References Cited

U.S. PATENT DOCUMENTS

| | | | |
|---|---|---|---|
| 3,736,899 | 6/1973 | Manske | 215/230 X |
| 3,987,668 | 10/1976 | Popenoe | 116/212 |
| 4,285,105 | 8/1981 | Kirkpatrick | 383/63 X |
| 4,479,585 | 10/1984 | Sandhaus | 215/218 |
| 4,489,841 | 12/1984 | Thompson | 215/203 |
| 4,591,055 | 5/1986 | Corn | 206/459 |
| 4,840,281 | 6/1989 | Phillips et al. | 215/230 |
| 4,877,143 | 10/1989 | Travisano | 215/230 |
| 4,905,851 | 3/1990 | Thompson | 215/203 |
| 5,005,719 | 4/1991 | Phillips et al. | 215/230 |
| 5,018,632 | 5/1991 | Schmidt | 215/230 |

*Primary Examiner*—Stephen K. Cronin

*Attorney, Agent, or Firm*—Lockwood, Alex, Fitzgibbon & Cummings

[57] ABSTRACT

A button enhancement coating system wherein mechanically actuated buttons and vacuum actuated buttons of closures may be provided with a coating system which changes color after the closure has been applied to a container and then removed therefrom with the change in color indicating tampering. The coating system includes a first coating layer applied directly to the upper surface of the button and a second coating layer of a different color applied in overlying and bonded relation to the first coating layer. The second coating layer is preferably transparent and the two colors are selected so that they produce a third color while the coating layers are bonded together. When the two coating layers become separated during the removal of the closure from a container, the button assumes the color of the second coating layer. The first coating layer may have an embossed upper surface including ribs and grooves with the second coating layer flowed thereinto. When the second coating layer is caused to shrink, mating can no longer be effected.

20 Claims, 3 Drawing Sheets

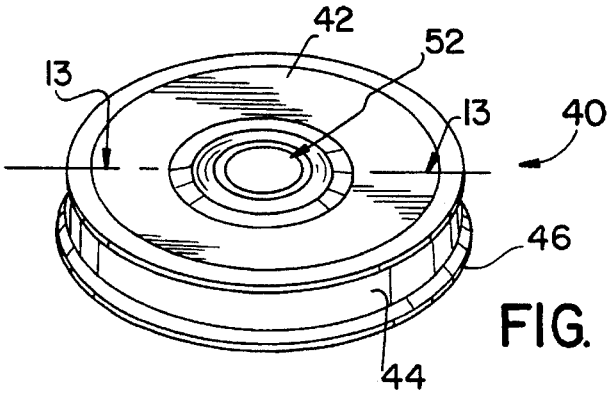
FIG. 12
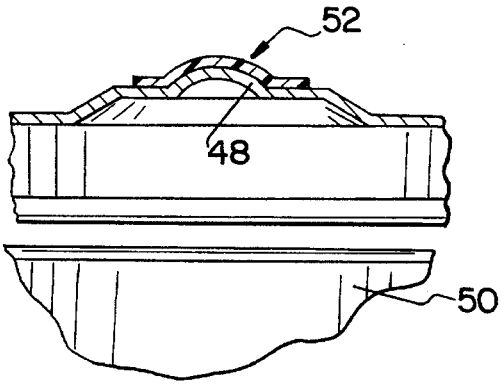
FIG. 13
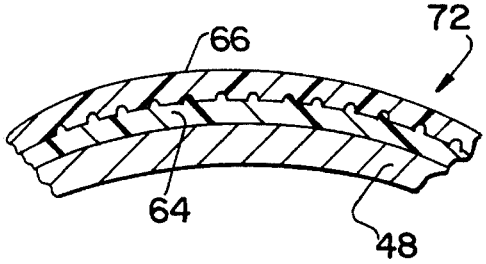
FIG. 9
FIG. 10
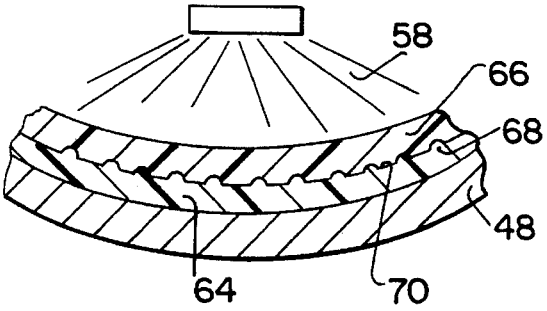
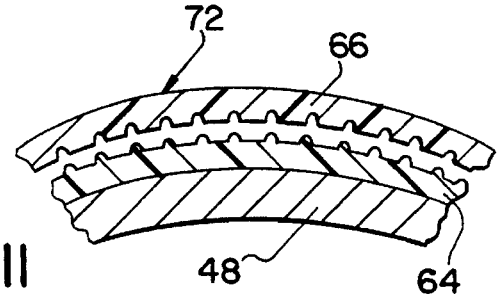
FIG. 11

BUTTON ENHANCEMENT COATING SYSTEM

This application is a continuation of application Ser. No. 08/061,272, filed May 13, 1993, now abandoned which is a continuation of application Ser. No. 07/884,866, filed May 13, 1992, now abandoned which is a continuation of application Ser. No. 07/585,179, filed Sep. 20, 1990 now abandoned. This invention relates in general to new and useful improvements in closures having tamper indicating means, and more specifically to a closure of the type having a button which is displaced when the closure is applied to a container so as to indicate the condition of closing.

BACKGROUND OF THE INVENTION

It is known to form closures with end panels having buttons formed therein so as to indicate the condition of closure. Such closures include those in which the button is actuated by a vacuum condition within an associated container and those wherein the buttons are mechanically actuated when the closure is applied to a container under non-vacuum conditions.

It is also known to associate with the buttons of closures indicating means which will provide either a color indication or a display showing that the closure has been applied and then removed.

SUMMARY OF THE INVENTION

In accordance with this invention, the closure condition indicating button is provided with an enhancement coating system which includes two differently colored layers with the outer layer being preferably transparent so as to provide a color which is a combination of the colors of the two layers as long as the two layers are bonded together. However, when the layers become separated, and the outer layer is spaced from the inner layer, the color appearance of the button is only that of the outer layer.

This invention most particularly relates to the shrinking of the outer layer so as to effect separation of the two layers when the button returns to its starting position after the closure has been removed from an associated container. In particular, the outer layer is formed of a partially polymerized material, which material is further polymerized after the closure has been applied to a container and the button displaced from its manufactured position so as to effect the shrinkage of the outer layer.

With the above and other objects in view that will hereinafter appear, the nature of the invention will be more clearly understood by reference to the following detailed description, the appended claims, and the several views illustrated in the accompanying drawings.

FIG. 9 is an enlarged fragmentary vertical sectional view taken through the button of FIG. 8 and shows the specific embossed configuration of the inner layer with the outer layer having flowed into the grooves formed in the outer surface of the inner layer.

FIG. 10 is an enlarged fragmentary sectional view through the button of FIG. 8 with the button deflected due to the application of the closure to a container and the outer layer being treated to effect the shrinkage thereof whereby separation of the two layers will be effected at least when the button snaps back to its original position.

FIG. 11 is another sectional view showing the button having returned to its original position and the shrinkage of the outer layer preventing an internesting of the opposed surfaces of the two layers.

FIG. 12 is a top perspective view of another closure which incorporates a vacuum actuated button.

FIG. 13 is an enlarged fragmentary vertical sectional view taken through the closure of FIG. 12 and shows the button with the enhancement coating system thereon.

DESCRIPTION OF PREFERRED EMBODIMENTS OF THE INVENTION

Figure 1:
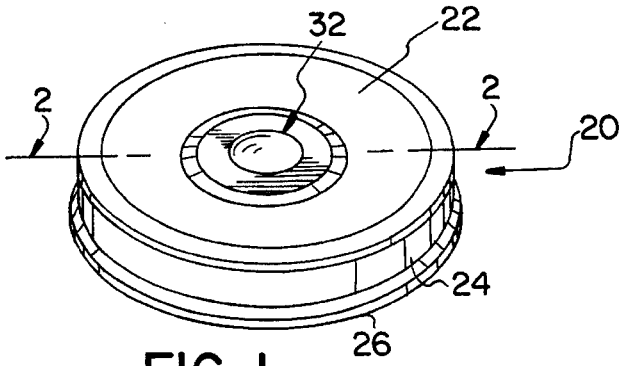
FIG. 1 is a top perspective view of a conventional type of closure having a mechanically actuated button.
Figure 2:
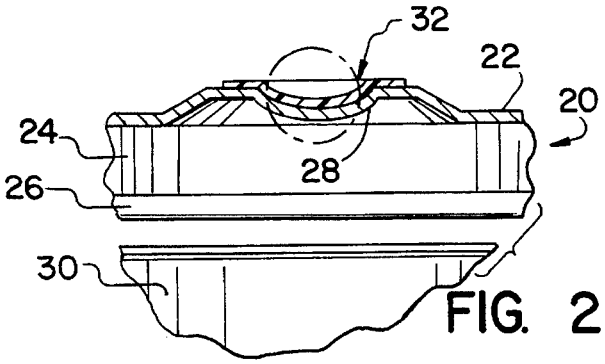
FIG. 2 is a fragmentary large vertical sectional view taken generally along the line 2—2 of FIG. 1 and shows more specifically the details of the button and the tamper indicating enhancement thereof.
Figure 5:
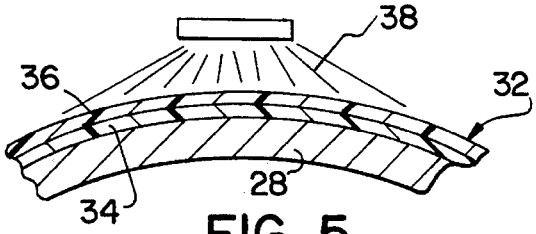
FIG. 5 is an enlarged fragmentary sectional view similar to FIG. 3 showing the button in its mechanically displaced position after the closure has been applied to a container with the outer layer being treated to effect shrinkage thereof.
Figure 6:
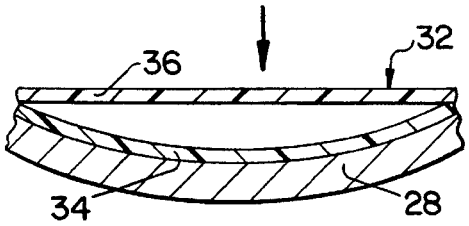
FIG. 6 is an enlarged fragmentary sectional view through the button after the closure has been removed from an associated container and the button mechanically returned to its original position and with the two layers having separated from one another.

Reference is first made to FIGS. 1–7 wherein there is illustrated a first embodiment of the invention which includes a closure generally identified by the numeral 20. The closure 20 is of a basic known construction and includes an end panel 22 carried by a cylindrical skirt 24 and the skirt 24 terminating in a curl 26 which will be provided with means for interlocking engagement with lugs of a conventional container. The central part of the end panel 22 is provided with a mechanically actuated button 28 which is best illustrated in FIG. 2 and which button has an as formed downwardly deflected configuration. When the closure 20 is applied to a container, such as the container 30, the button 28 will be deflected to an upwardly directed position as is shown in FIG. 5. Then when the closure 20 is removed from the container 30, the button 28, due to internal forces, will snap back down to its original position as shown in FIG. 6.

This invention particularly relates to a button enhancement coating system which is applied to the button 28 and is generally identified by the numeral 32. The button enhancement coating system 32 is particularly constructed to specifically designate that the closure 20 has been removed from the container 30 even if the closure 20 is again placed on the container 30 in a sealed closed position and thus forms tamper indicating means for the closure 20.

Figure 3:
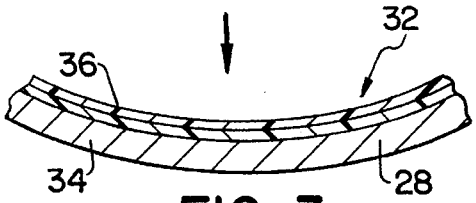
FIG. 3 is an enlargement of the encircled portion of FIG. 2 and shows specifically the details of the tamper indicating enhancement with the button in its down as manufactured position.
Figure 4:
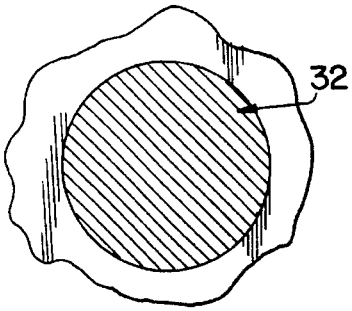
FIG. 4 is a plan view of the button displaying a certain color.

As is best shown in FIGS. 3, 5 and 6, the button enhancement coating system 32 includes a first colored layer 34 in the form of a coating applied to the button 28 for movement with the button 28. The button enhancement coating system 32 also includes a second layer 36 which overlies the coating layer 34 and is initially bonded thereto, the layer 36 being in the form of a partially polymerized transparent coating which is of a second and different color from the layer 34.

Figure 7:
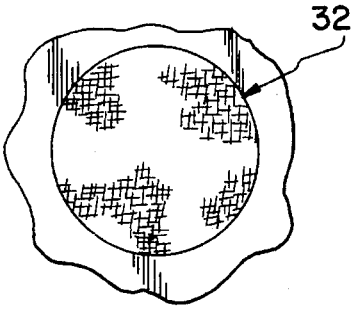
FIG. 7 is a plan view of the button in its condition of FIG. 6 wherein the appearance of the button is of another color.

A typical example of the colors of the layers 34 and 36 would be for the layer 34 to be blue and the layer 36 to be yellow. When the two coatings are bonded together, particularly due to the transparency of the coating 36, the coating system would have a green appearance. However, when the two layers 34, 36 are separated, as shown in FIGS. 6 and 7, only the color of the yellow layer 36 would be seen.

While the colors have been specifically identified as yellow and blue so as to produce green, it is to be understood that there are recognized other combinations of two colors which, when combined, form a third color. A typical example would be the combination of red and yellow which produces orange. This and other color combinations are feasible in accordance with this invention.

In accordance with this invention, it is intended that after the closure 20 has been applied to the container 30 and then removed therefrom, the layers 34 and 36 will become permanently separated and that the color of the coated button 28 will remain that of the layer 36 even if the closure is reapplied to the container. In order to effect this, after the closure 20 has been applied to the container 30 and the button 28 mechanically displaced upwardly as shown in FIG. 5, the outer layer 36 is treated so as to effect a shrinkage of the same. After this treatment, the bond between the layers 34, 36 is just enough to keep the two layers from separating at this time. However, when the button 28 snaps down due to the retained energy therein, to the position of FIG. 6, since the layer 36 is of a lesser extent than the layer 34, it will become separated from the layer 34 as is shown in FIG. 6. Thus the color of the button 38 goes from green to yellow when the colors of the layers 34 and 36 are blue and yellow, respectively.

As initially stated, it is preferred that the layer 36 be a partially polymerized coating. In accordance with this invention, it is preferred that treatment 38 be in the form of a further polymerization of the layer 36 as is schematically shown in FIG. 5. This may be effected by ion-U.V. or other sources.

Reference is now made to FIGS. 12–16 wherein there is illustrated a closure generally identified by the numeral 40. The closure 40 is of a construction somewhat similar to that of the closure 20 and includes an end panel 42 carried by a generally cylindrical skirt 44 which terminates in a lower curl 46 having means (not shown) for interlock securing engagement with a container such as the container 50 of FIG. 13. The end panel 42 is provided with a container closed position indicating button 48 as shown in FIG. 13 in a manner similar to the button 28. However, it is to be noted that in the as formed condition of the closure 40, the button 48 is directed upwardly and the closure 40 is particularly constructed to form part of a vacuum packed package with the vacuum within the container 50 drawing the button 48 downwardly when the vacuum is effected in such package.

The button 48 is provided with a button enhancement coating system generally identified by the numeral 52 with the coating system being substantially identical to that of the coating system 32.

Figure 14:
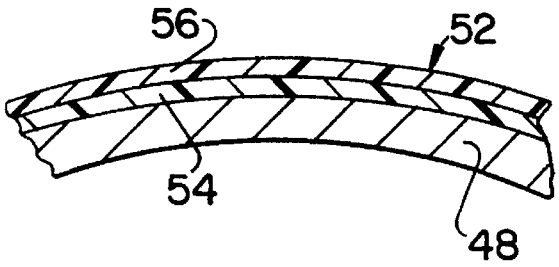
FIG. 14 is an enlarged fragmentary vertical sectional view of the encircled portion of the button of FIG. 13 and shows more specifically the details of the enhancement coating system.
Figure 15:
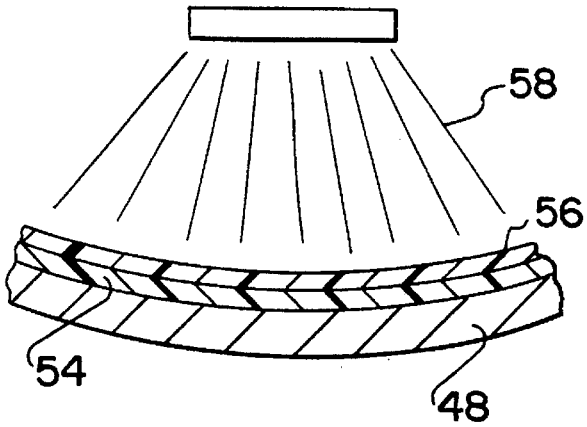
FIG. 15 is a sectional view similar to FIG. 14 and shows the button in a downwardly drawn position when the closure is applied to a vacuum packed container, the view also shows the treatment of the outer layer to effect shrinkage thereof.
Figure 16:
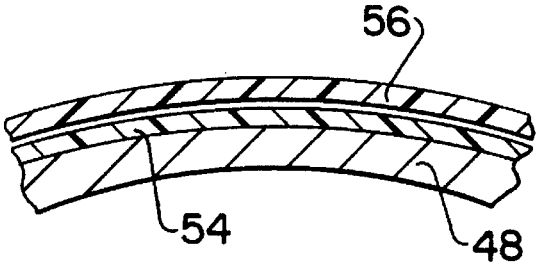
FIG. 16 is another vertical sectional view similar to FIG. 14 and shows the button as it appears when it returns to Its original position following the removal of the closure from the vacuum packed container with the two layers being spaced apart.

Referring now to FIGS. 14, 15 and 16, it will be seen that the button enhancement coating system 52 includes a first colored coating 54 which is applied to the top surface of the button 48 for movement therewith. A second colored coating 56 is applied over the coating 54 and is bonded thereto. The coatings 54 and 56 may be identical to the coatings 34 and 36, respectively with the coating 54 being a blue coating and the coating 56 being a partially polymerized transparent yellow coating or other color combinations may be utilized as discussed above.

Referring now to FIG. 15, it will be seen that when the closure 40 is applied to the container 50 and a vacuum is drawn within the container 50, the button 48 is displaced to a downwardly projecting position. At this time the coating 56 is provided with a treatment generally designated by the numeral 58 so as to effect a shrinkage of the layer 56. This treatment 58 will be of the same type as the previously described treatment 38 and in the case where the layer is partially polymerized coating, will be in the form of a further polymerization of the layer 56. At this time the bond between the layers 54, 56 is just enough to keep the two layers from separating.

It is to be understood that when the button 48 is in the down position of FIG. 15, it has stored energy and when the vacuum is removed by the removal of the closure 40, the button 48 will snap upwardly to its original position as shown in FIG. 16 with the result that the layer 56 separates from the layer 54 and the color appearance of the button 48 changes from green to yellow, for example.

It is also to be understood that if the closure 40 is again applied to the container 50 and a further vacuum drawn within the container 50, even though the button 48 will be deflected downwardly to the position shown in FIG. 15, the two layers 54, 56 will not be bonded together but will further separate and the color of the button will remain yellow to indicate that there has been tampering.

Figure 8:
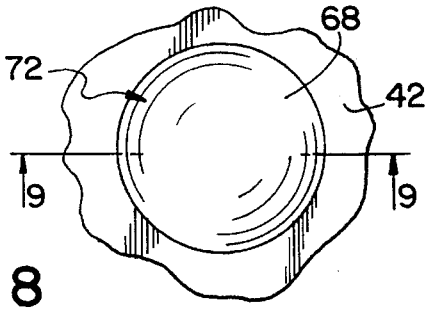
FIG. 8 is a plan view of a slightly modified button wherein time inner layer is embossed to provide a plurality of concentric grooves.

Reference is now made to FIGS. 8 through 11 which illustrates a slightly modified form of the coating layers, the first layer being identified by the numeral 64 and the second layer being identified by the numeral 66. The layer 64 differs from the layer 54 in that when applied to the button 48, it is embossed so that the upper surface of the layer 64 includes upstanding ribs separated by grooves 70. In a preferred embodiment of the rib and groove arrangement, the ribs 68 are arranged in concentric circles as shown in FIG. 8. Further, it is to be understood that the ribs 68 may be of varying widths.

The coating 66 differs from the coating 56 in that when applied to the coating layer 64, the undersurface thereof will flow into the grooves 70 and thus the undersurface of the coating layer 66 will mate with the upper surface of the coating layer 64. This is clearly shown in FIG. 9 with the button enhancement coating system being generally identified by the numeral 72.

After the closure of FIGS. 8–11 has been applied to a container and a vacuum drawn within the container, the button 48 is drawn downwardly as shown in FIG. 10. At this time the treatment 58 is applied to the coating 66 so as to effect shrinkage thereof as described with respect to FIG. 10. At this time there still remains a very slight bond between the layers 64, 66.

When the closure is removed from the associated container, the stored energy of the button 48 will result in the same flipping upwardly to the position shown in FIG. 11 and the two layers 64, 66 separating. Further, since the layer 66 has shrunk, the previously mating surfaces thereof no longer mate and, therefore, there would be only a limited touching of ribs thereof as is shown in FIG. 11 . Thus, should the closure again be applied to a container and a vacuum drawn in such container, the layers 64, 66 cannot once again bond so as to provide the green color, the button enhancement coating system 72 always remaining yellow in color.

At this time it is to be understood that although the button enhancement coating system 72 utilizing the embossed coating layer 64 has been illustrated only with respect to the closure 40, a similar system may be utilized in conjunction with the closure 20.

Although only several preferred embodiments of the invention have been specifically illustrated and described herein, it is to be understood that minor variations may be made in the button enhancement coating systems without departing from the spirit and scope of the invention as defined by the appended claims.

I claim:

1. A closure having an end panel including a package condition indicating deflectable button, and tamper indicating means carried by said button to permanently indicate that said closure has been applied to a container and removed, said tamper indicating means comprising a first colored coating layer bonded to an exterior of said button, and a second colored coating layer releasably bonded to an exterior surface of said first colored coating layer, said colors of said layers combining to display one color when said colored coating layers are bonded together and to display only the color of said second colored coating layer when said colored coating layers become separated.

2. A closure according to claim 1 wherein said second colored coating layer is a partially polymerized material.

3. A closure according to claim 1 wherein said button is a mechanically actuated button having an unapplied down position.

4. A closure according to claim 1 wherein said button is a vacuum actuated button having an unapplied up position.

5. A closure according to claim 1 wherein said second colored coating layer is transparent.

6. A closure according to claim 1 wherein said closure has been applied to a container, said button has been deflected to indicate a properly closed state, and said second colored coating layer has been treated to effect shrinkage of said second colored layer.

7. A closure according to claim 6 wherein said second colored coating layer has been bonded directly to said first colored coating layer and the bond between said colored coating layers is just enough to keep said colored coating layers from separating until said button is deflected.

8. A closure according to claim 6 wherein said closure has been removed from said container and said button has returned to its initial shape, said two colored coating layers have separated, and the color of said tamper indicating means is substantially that of said second colored coating layer evidencing application and then removal of said closure.

9. A closure according to claim 6 wherein said second colored coating layer is a partially polymerized material, and treatment effecting shrinkage of said second colored coating layer is a further polymerization of said material of said second colored coating layer.

10. A closure according to claim 6 wherein said button is a mechanically actuated button having an unapplied down position, and an applied up position.

11. A closure according to claim 6 wherein said button is a vacuum actuated button having an unapplied up position, and an applied down position.

12. A closure according to claim 1 wherein said exterior surface of said first colored coating layer is embossed to have spaced upstanding ribs, and said second colored coating layer has an interior surface flowed into depressions between said ribs.

13. A closure according to claim 12 wherein said ribs are concentrically arranged.

14. A closure according to claim 12 wherein said ribs are concentrically arranged, and of different widths.

15. A closure according to claim 12 wherein said ribs are of different widths.

16. A method of forming a tamper indicating closure having means for indicating that said closure has been applied to a container and then released, said method comprising the step of providing a closure having an end panel including a package condition indicating deflectable button, and tamper indicating means carried by said button to permanently indicate that said closure has been applied to a container and removed, said tamper indicating means comprising a first colored coating layer bonded to an exterior of said button, and a second colored coating layer releasably bonded to an exterior surface of said first colored coating layer, said colors of said layers combining to display one color when said colored coating layers are bonded together and to display only the color of said second colored coating layer when said colored coating layers become separated, applying said closure to a container and deflecting said button, and treating said second colored coating layer to effect shrinkage of said second layer whereby when said closure is removed from said container and said button deflects to its original position said colored coating layers will separate and said tamper indicating means will permanently change color.

17. A method according to claim 16 wherein said closure is formed with a mechanically actuated button.

18. A method according to claim 16 wherein said closure is formed with a vacuum actuated button.

19. A method according to claim 16 wherein said second colored coating layer is formed as a partially polymerized material, and said treating is in the form of further polymerization of said second colored coating layer.

20. A method according to claim 16 wherein said colored coating layers are formed with mating ribbed surfaces.

* * * * *